US012127623B2

(12) United States Patent
Pomering et al.

(10) Patent No.: US 12,127,623 B2
(45) Date of Patent: Oct. 29, 2024

(54) CONNECTOR WITH A DEFORMABLE RETAINER

(71) Applicant: MIPS AB, Täby (SE)

(72) Inventors: Amy Louise Pomering, Täby (SE); Christopher Pietrzak, Täby (SE); Saman Xie, Täby (SE)

(73) Assignee: MIPS AB, Täby (SE)

( * ) Notice: Subject to any disclaimer, the term of this patent is extended or adjusted under 35 U.S.C. 154(b) by 666 days.

(21) Appl. No.: 17/289,789

(22) PCT Filed: Nov. 8, 2019

(86) PCT No.: PCT/EP2019/080752
§ 371 (c)(1),
(2) Date: Apr. 29, 2021

(87) PCT Pub. No.: WO2020/094869
PCT Pub. Date: May 14, 2020

(65) Prior Publication Data

US 2021/0401104 A1 Dec. 30, 2021

(30) Foreign Application Priority Data

Nov. 8, 2018 (GB) ..... 1818219

(51) Int. Cl.
*A42B 3/14* (2006.01)
*A42B 3/06* (2006.01)

(52) U.S. Cl.
CPC ..... *A42B 3/147* (2013.01); *A42B 3/064* (2013.01)

(58) Field of Classification Search
CPC ..... A42B 3/147; A42B 3/064; A42B 3/063; A42B 3/10; A42B 3/12
See application file for complete search history.

(56) References Cited

U.S. PATENT DOCUMENTS

| | | | | |
|---|---|---|---|---|
| 2013/0247284 | A1 | 9/2013 | Hoshizaki et al. | |
| 2017/0172242 | A1 | 6/2017 | Leatt et al. | |
| 2018/0000186 | A1 | 1/2018 | Brown | |
| 2018/0271198 | A1* | 9/2018 | Ku | A42B 3/064 |

FOREIGN PATENT DOCUMENTS

| | | | |
|---|---|---|---|
| CN | 111936003 | A | 11/2020 |
| WO | 0145526 | A1 | 6/2001 |
| WO | 2011139224 | A1 | 11/2011 |
| WO | 2017157765 | A1 | 9/2017 |
| WO | 2018177791 | A1 | 10/2018 |
| WO | 2019101816 | A1 | 5/2019 |

* cited by examiner

*Primary Examiner* — Sally Haden
(74) *Attorney, Agent, or Firm* — Husch Blackwell LLP

(57) ABSTRACT

There is disclosed a connector for connecting first and second parts of an apparatus, the connector comprising: a deformable retainer having first and second sides around an inner space; and a first plate positioned within the inner space to provide a low friction interface between the first and second sides of the retainer; wherein the first side of the retainer has a first anchor point that is configured to connect the connector to the first part of the apparatus; and the second side of the retainer has a second anchor point that is configured to connect the connector to the second part of the apparatus.

18 Claims, 6 Drawing Sheets

CONNECTOR WITH A DEFORMABLE RETAINER

RELATED APPLICATIONS

This application is a 35 USC § 371 National Stage application of International Application No. PCT/EP2019/080752, entitled "CONNECTOR," filed on Nov. 8, 2019, which claims the benefit of United Kingdom Patent Application No. 1818219.6, filed on Nov. 8, 2018, the disclosure of which is incorporated herein by reference in its entirety.

The present invention relates to a connector, which may be used to connect two parts of an apparatus, for example for connecting a liner or comfort padding to the remainder of a helmet.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, soccer, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. In other arrangements, such as a rugby scrum cap, a helmet may have no hard outer shell, and the helmet as a whole may be flexible. In any case, nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

In helmets such as those disclosed in WO 2001/045526 and WO 2011/139224 that may reduce the rotational energy transmitted to the brain caused by oblique impacts, the first and second parts of the helmet may be configured to slide relative to each other following an oblique impact. However, it remains desirable for the first and second parts to be connected such that the helmet retains its integrity during normal use, namely when not subject to an impact. It is therefore desirable to provide connectors that, whilst connecting first and second parts of a helmet together, permit movement of the first part relative to the second part under an impact. It is also desirable to provide connectors within a helmet that can be provided without substantially increasing the manufacturing costs and/or effort.

The connectors in WO 2017/157765 address some of issues mentioned above. However, they can be relatively fiddly and time-intensive to manufacture. The present invention aims to at least partially address this problem by providing an easy to manufacture connector that permits relative movement under impact.

According to a first aspect of the present invention, there is provided a connector for connecting first and second parts of an apparatus, the connector comprising: a deformable retainer having first and second sides around an inner space; and a first plate positioned within the inner space to provide a low friction interface between the first and second sides of the retainer; wherein the first side of the retainer has a first anchor point that is configured to connect the connector to the first part of the apparatus; and the second side of the retainer has a second anchor point that is configured to connect the connector to the second part of the apparatus. The provision of the plate between the sides of the deformable retainer creates a low friction interface that allows the sides to move relative to each and thus allow the first and second parts of an apparatus to move relative to each other.

Optionally, the connector further comprises a second plate positioned within the inner space, the first and second plate being configured to slide with respect to each other to provide the low friction interface between the first and second sides of the retainer.

Optionally, the retainer has an aperture, optionally a slit, for inserting the first plate. The aperture can be on a second side of the retainer.

Optionally, the second anchor point comprises a pair of arms extending outwards from opposite edges of the aperture. The arms can be integrally formed with the retainer. The he arms can be deformable. The arms can extend across the second side of the retainer. The arms can extend beyond the second side of the retainer. The connector can be configured to connect to the second part of the apparatus by passing the arms through an opening in the second part of the apparatus.

Optionally, the deformable retainer is at least partially formed from a deformable material. The deformable material can be substantially elastically deformable. The deformable material can be a silicone elastomer.

Optionally, the deformable retainer comprises a fastener positioned on the first side of the retainer as the first anchor point. The fastener can be formed from a relatively stiff hard compared to the deformable material.

Optionally, the first anchor point comprises space for applying adhesive.

Optionally, the first plate is not fixed to the retainer. The second plate may not be either.

Optionally, the first plate comprises a low friction material.

According to a second aspect of the invention, there is provided a liner for a helmet, comprising a connector according the first aspect.

Optionally, the first anchor point of the connector is configured to be connected to the helmet.

Optionally, the liner comprises comfort padding and optionally a layer of relatively hard material, compared to the comfort padding, provided more outwardly than the comfort padding.

According to a third aspect of the invention, there is provided a helmet, comprising a liner according to the second aspect.

Optionally, the liner is removable from the helmet.

According to a fourth aspect of the invention, there is provided a method of assembling a connector for connecting first and second parts of an apparatus, the method comprising: forming a deformable retainer having first and second sides around an inner space, a first anchor point that is configured to connect a first side of the connector to the first part of the apparatus, and a second anchor point that is configured to connect the second side of the connector to the second part of the apparatus; and positioning a first plate within the inner space to provide a low friction interface between the first and second sides of the retainer.

Optionally, the connector is the connector of the first aspect.

The invention is described in detail, below, with reference to the accompanying figures, in which.

Figure 1:
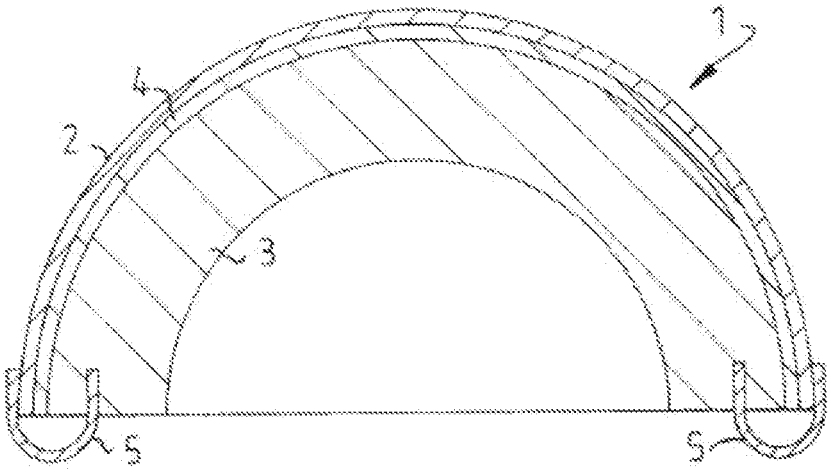
FIG. 1 depicts a cross-section through a helmet for providing protection against oblique impacts.

The proportions of the thicknesses of the various layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 or a sliding facilitator, and thus makes possible displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connecting members 5 may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic or metal which are anchored in the outer shell and the inner shell in a suitable manner.

Figure 2:
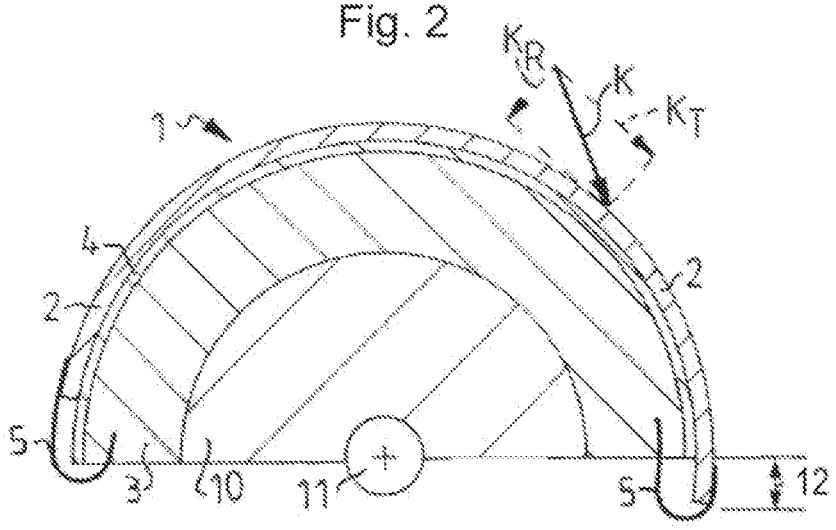
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force KT and a radial force KR against the protective helmet 1. In this particular context, only the helmet-rotating tangential force KT and its effect are of interest.

As can be seen, the force K gives rise to a displacement 12 of the outer shell 2 relative to the inner shell 3, the connecting members 5 being deformed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
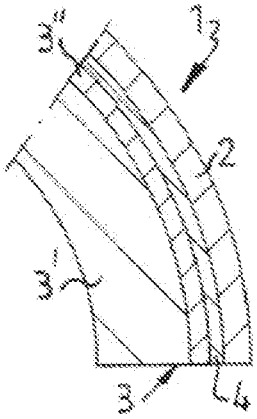
FIGS. 3A, 3B & 3C show variations of the structure of the helmet of FIG. 1.
Figure 3B:
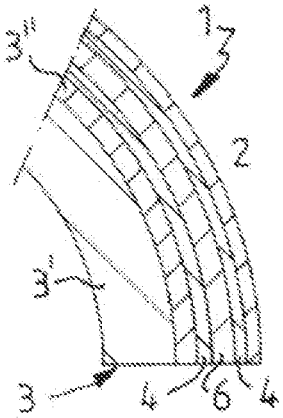
Figure 3C:
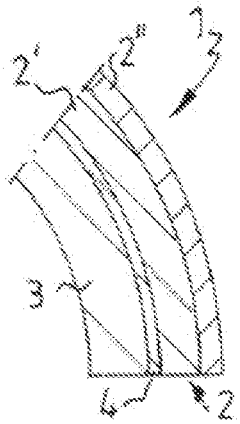

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently to previously. In this case, a harder outer layer 2" covers a softer inner layer 2'. The inner layer 2' may, for example, be the same material as the inner shell 3.

Figure 4:
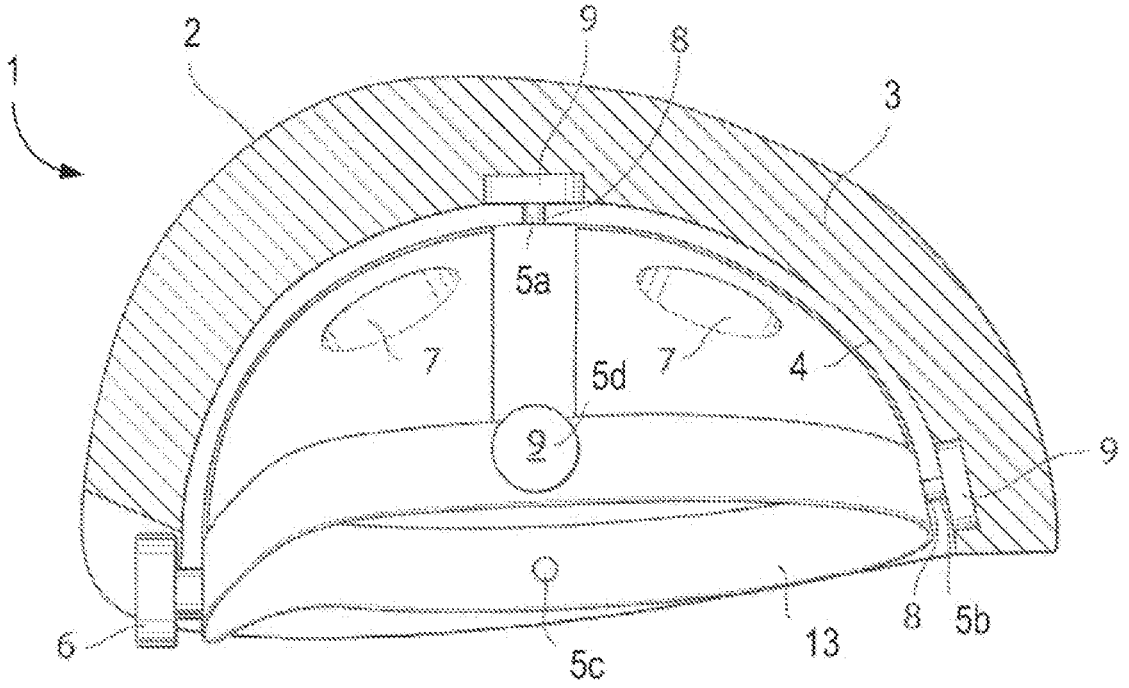
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 5 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, FEP, PE and UHMWPE, or a powder material which could be infused with a lubricant. The low friction material could be a fabric material. As discussed, this low friction material could be applied to either one, or both of the sliding facilitator and the energy absorbing layer.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
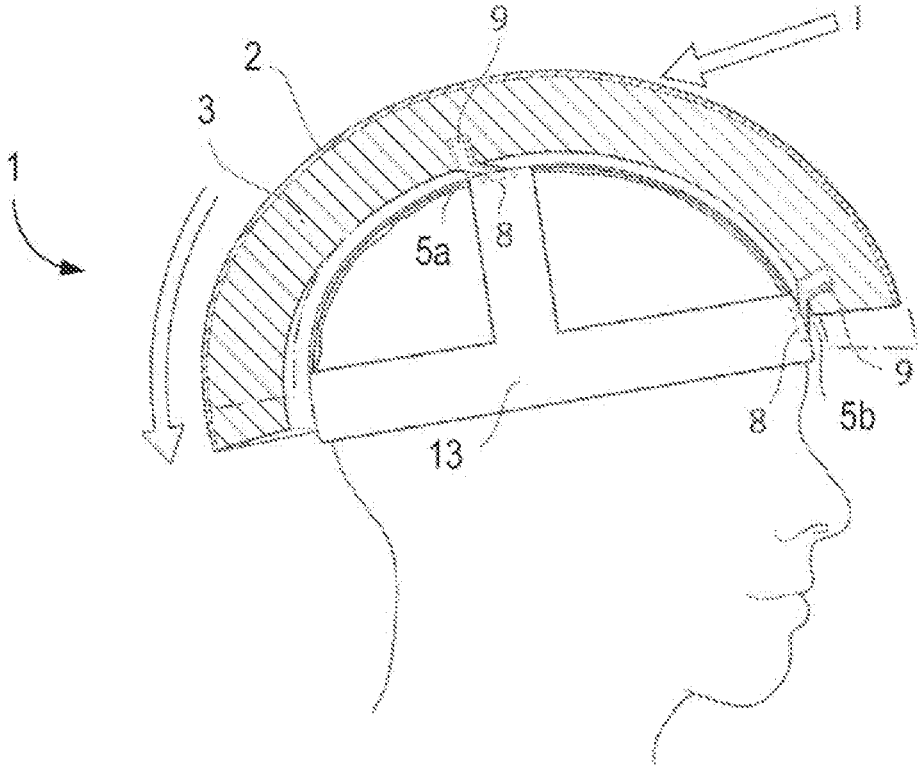
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and STBI such as subdural haematomas, SDH, blood vessel rapturing, concussions and DAI is thereby reduced.

Connectors of the present invention for connecting two parts of an apparatus are described below. It should be appreciated that these connectors may be used in a variety of contexts and are not be limited to use within helmets. For example, they may be used in other devices that provide impact protection, such as body armour or padding for sports equipment. In the context of helmets, the connectors of the present invention may, in particular, be used in place of the previously known connecting members and/or fixing members of the arrangements discussed above.

Figure 6:
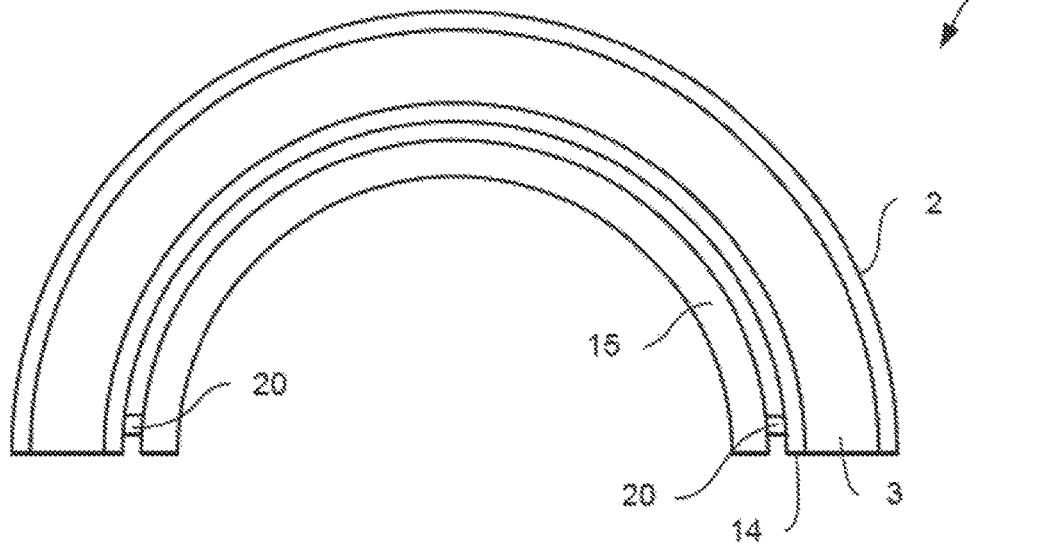
FIG. 6 depicts, in cross-section, a helmet according to an embodiment of the present invention.

In an embodiment of the invention, the connector may be used with a helmet 1 of the type shown in FIG. 6. The helmet shown in FIG. 6 has a similar configuration to that discussed above in respect of FIGS. 4 and 5. In particular, the helmet has a relatively hard outer shell 2 and an energy absorbing layer 3. A head attachment device is provided in the form of a helmet liner 15. The liner 15 may include comfort padding as discussed above. In general, the liner 15 and/or any comfort padding may not absorb a significant proportion of the energy of an impact in comparison with the energy absorbed by the energy absorbing layer 3.

The liner 15 may be removable. This may enable the liner to be cleaned and/or may enable the provision of liners that are modified to fit a specific wearer.

Between the liner 15 and the energy absorbing layer 3, there is provided an inner shell 14 formed from a relatively hard material, namely a material that is harder than the energy absorbing layer 3. The inner shell 14 may be moulded to the energy absorbing layer 3 and may be made from any of the materials discussed above in connection with the formation of the outer shell 2.

In the arrangement of FIG. 6, a low friction interface is provided between the inner shell 14 and the liner 15. This may be implemented by the appropriate selection of at least one of the material used to form the outer surface of the liner 15 or the material used to form the inner shell 14. Alternatively or additionally, a low friction coating may be applied to at least one of the opposing surfaces of the inner shell 14 and the liner 15. Alternatively or additionally, a lubricant may be applied to at least one of the opposing surfaces of the inner shell 14 and the liner 15.

As shown, the liner 15 may be connected to the remainder of the helmet 1 by way of one or more connectors 20 of the present invention, discussed in further detail below. Selection of the location of the connectors 20 and the number of connectors 20 to use may depend upon the configuration of the remainder of the helmet. Accordingly, the present invention is not limited to the configuration depicted in FIG. 6.

In an arrangement such as shown in FIG. 6, at least one connector 20 may be connected to the inner shell 14. Alternatively or additionally, one or more of the connectors 20 may be connected to another part of the remainder of the helmet 1, such as the energy absorbing layer 3 and/or the outer shell 2. The connectors 20 may also be connected to two or more parts of the remainder of the helmet 1.

Figure 7:
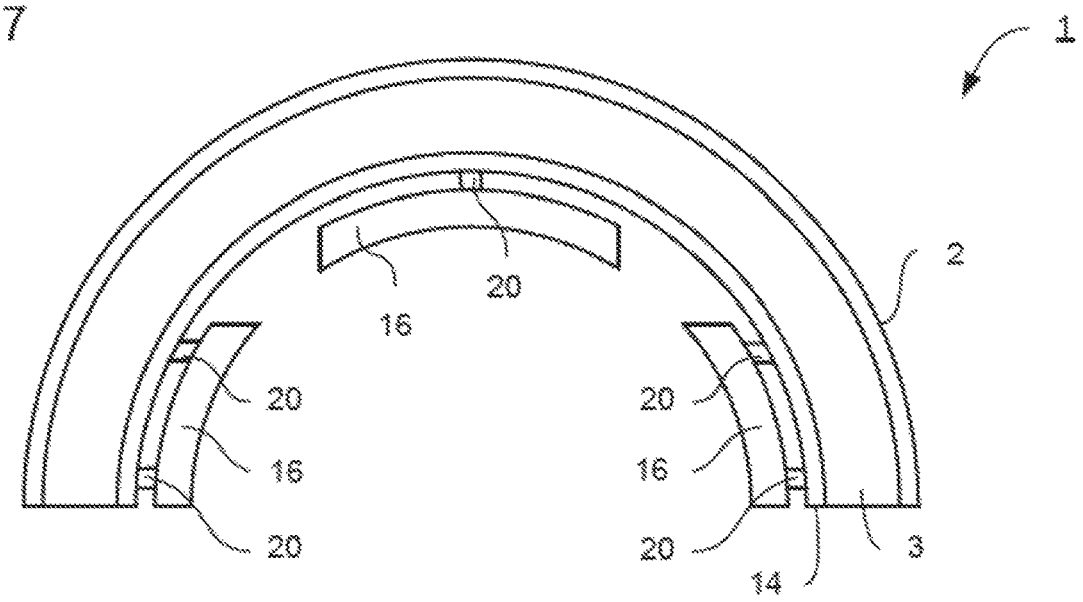
FIG. 7 depicts, in cross section, a helmet according to an embodiment of the present invention.

FIG. 7 depicts a further alternative arrangement of a helmet 1 using the connectors 20 of the present invention. As shown, the helmet 1 of this arrangement includes a plurality of independent sections of comfort padding 16. Each section of comfort padding 16 may be connected to the remainder of the helmet by one or more connectors 20 according to the present invention.

The sections of comfort padding 16 may have a sliding interface provided between the sections of comfort padding 16 and the remainder of the helmet 1. In such an arrangement, the sections of comfort padding 16 may provide a similar function to that of the liner 15 of the arrangement shown in FIG. 6. The options discussed above for provision of a sliding interface between a liner and a helmet also apply to the sliding interface between the sections of comfort padding and the helmet.

It should also be appreciated that the arrangement of FIG. 7, namely the provision of a plurality of independently mounted sections of comfort padding 16 provided with a sliding interface between the sections of comfort padding 16 and the remainder of the helmet may be combined with any form of helmet, including those such as depicted in FIGS. 1 to 5 that also have a sliding interface provided between two other parts of the helmet.

Figure 8:
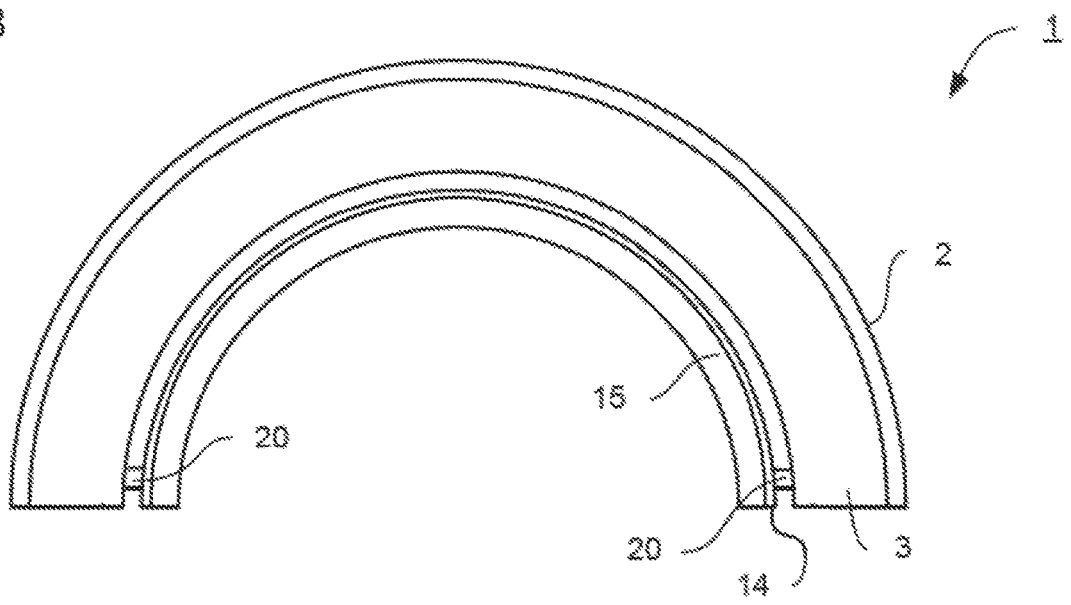
FIG. 8 depicts, in cross-section, a helmet according to another embodiment of the present invention.
Figure 9:
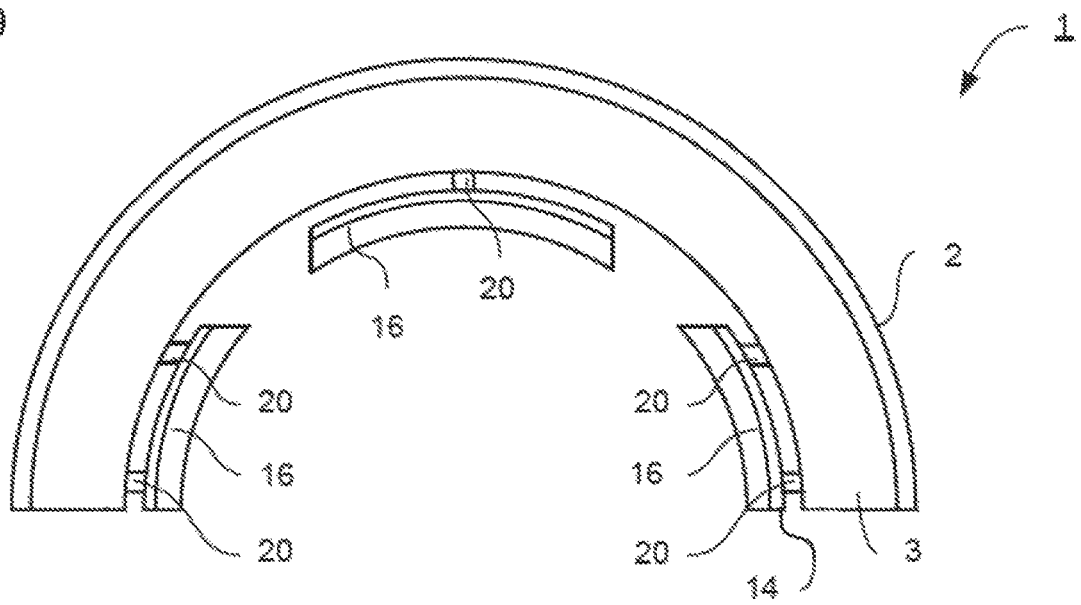
FIG. 9 depicts, in cross section, a helmet according to another embodiment of the present invention.

FIGS. 8 and 9 show equivalent embodiments to those of FIGS. 6 and 7, except that the inner shell 14 is applied to the liner 15 (in FIG. 8) or comfort padding 16 (in FIG. 9). In the case of FIG. 9, the inner shell 14 may only be a partial shell or a plurality of sections of shell, as compared to the substantially full shell arrangements of FIGS. 6 to 8. Indeed, in both FIGS. 8 and 9 the inner shell 14 may also be characterised as a relatively hard coating on the liner 15 or comfort padding 16. As for FIGS. 6 and 7, the inner shell 14 is formed from a relatively hard material, namely a material that is harder than the energy absorbing layer 3. For example, the material could be PTFE, ABS, PVC, PC, Nylon, PFA, FEP, PE and UHMWPE. The material may be bonded to the outer side of the liner 15 or comfort padding 16 to simplify the manufacturing process. Such bonding could be through any means, such as by adhesive or by high frequency welding.

In FIGS. 8 and 9 a low friction interface is provided between the inner shell 14 and the energy absorbing layer 3. This may be implemented by the appropriate selection of at least one of the material used to form the outer surface of the energy absorbing layer 3 or the material used to form the inner shell 14. Alternatively or additionally, a low friction coating may be applied to at least one of the opposing surfaces of the inner shell 14 and the energy absorbing layer 3. Alternatively or additionally, a lubricant may be applied to at least one of the opposing surfaces of the inner shell 14 and the energy absorbing layer 3.

In FIGS. 8 and 9, at least one connector 20 may be connected to the inner shell 14. Alternatively or additionally, one or more of the connectors 20 may be connected to another part of the remainder of the liner 15 or comfort padding 16.

Connectors 20 according to the present invention will now be described. For convenience, the connectors 20 will be described in the context of a connector for connecting a liner 15 to the remainder of a helmet 1 as depicted in FIG. 8. However, it should be appreciated that the connector 20 of the present invention may be used for connecting any two parts of an apparatus together. Furthermore, where below the connector 20 is described as having a first component connected to a first part of an apparatus, such as a helmet liner 15, and a second component connected to a second part of an apparatus, such as the remainder of the helmet 1, it should be appreciated that, with suitable modifications, this may be reversed.

Figure 10:
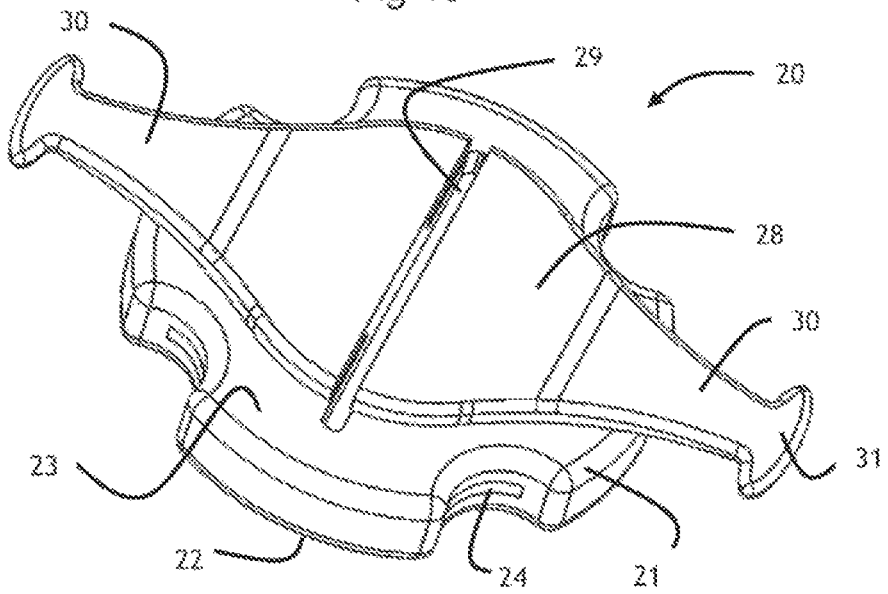
FIG. 10 depicts, in perspective view, a connector according to an embodiment of the present invention.

FIG. 10 shows a perspective view of a connector 20. The connector 20 is for connecting first and second parts of an apparatus, for example connecting an energy absorbing layer 3 of a helmet to an inner shell 14/liner 15 combination as depicted in FIG. 8.

Figure 11:
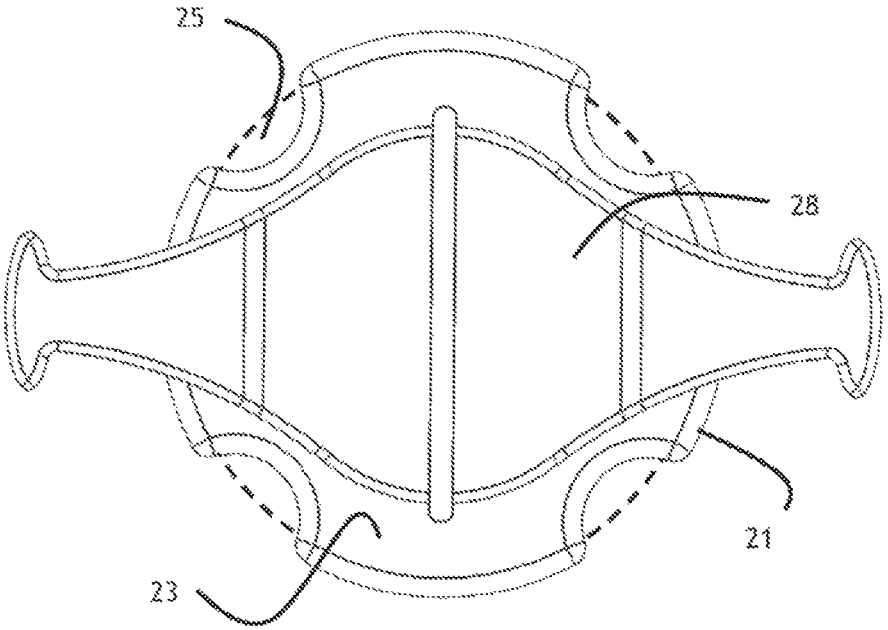
FIG. 11 depicts, in plan view, a connector according to FIG. 10.
Figure 12:
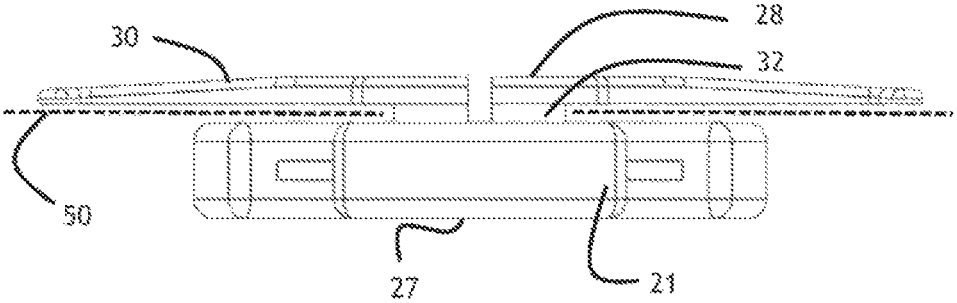
FIG. 12 depicts, in side view, a connector according to FIG. 10.

The connector 20 has a deformable retainer 21. The deformable retainer 21 has first and second sides 22, 23 around an inner space 24. As such, the deformable retainer 21 forms a pouch or pocket surrounding the inner space 24. However, the inner space 24 need not be entirely enclosed or surrounded by the deformable retainer 21. As shown in FIG. 12, the retainer 21 may have cutaway sections exposing the inner space 24. As discussed later, one or more plates 25, 26 may be provided within the inner space 24. As shown in FIG. 11, these plates may protrude out of the inner space 24 and out of the deformable retainer 21, through the cutaway sections. However, as also shown in FIG. 11, at least a portion of the periphery of retain 21 is not cutaway in order to retain the plates 25, 26 within the retainer 21. In other words, at least several points around the perimeter of the retainer 21, as illustrated in FIG. 11, wrap around the outer edge of the plates 25, 26. In some arrangements, the entire outer edge of the plates may be covered by the retainer 21, rather than just parts as shown in FIG. 11.

The first and second sides 22, 23 of the retainer 21 are each provided with an anchor point to connect the connector 20 to the first and second parts of the apparatus respectively. That is, the first side 22 of the retainer 21 has a first anchor point 27. In other words, the body of the retainer 21 itself comprises the anchor point 27. The anchor point 27 is not, for example, part of the plates 25, 26 positioned within the inner space 24 defined by the retainer 21. The first anchor point 27 is configured to connect the connector 20 to the first part of the apparatus. Similarly, the second side of the retainer 21 has a second anchor point 28. The second anchor point 28 is configured to connect the connector 20 to the second part of the apparatus.

A particular example of a second anchor point 28 is discussed in more detail below, however a first anchor point 27 is simply depicted in FIG. 12 in the form of a blank space. Such a blank space could be used to apply an adhesive to fix the connector to the first part of the apparatus to be connected, for example. Alternatively, this area could be used to provide one side of a hook and loop connector (the other side being on the part to be connected to). The area could also be used for providing other methods of attachment, as befits the particular application for which the connector 20 is being used, such as for high frequency welding or providing part of a magnetic connector.

As such, the first anchor point 27 (and, indeed, the second anchor point 28) can be used for permanent or releasable connection to the first part (or second part, in respect of the second anchor point 28), as necessary. Either type of attachment (detachable or permanent) may be configured such that it prevents translational movement of a respective anchor point 27, 28 relative to the part being connected to. However, anchor points 27, 28 may be configured to allow rotation (e.g. in the case of a snap fitting) about one or more axes of rotation relative to the part being connected to. The anchor points 27, 28 may also be connected to the parts to be connected by way of one or more additional components.

Figure 14:
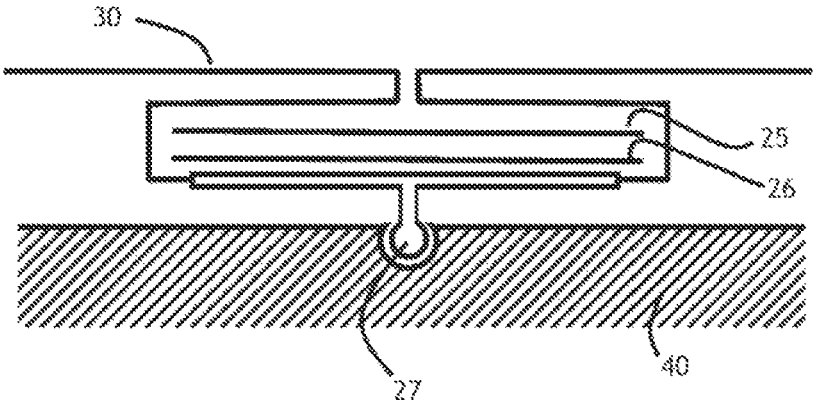
FIG. 14 depicts, in schematic cross-sectional view, an alternative to that shown in FIG. 13.

FIG. 14 shows an alternative first anchor point 27 in the form of a fastener. In particular, the anchor point forms one half of a snap-fit connection, the other half being in first part 40 being connected by the connector 20. As illustrated, the fastener itself may be incorporated into the body of the retainer 21. In other words, the fastener is part of the body of the retainer 21.

In general, the deformable retainer 21 is at least partially formed from a deformable material. However, as in the embodiment of FIG. 14, the deformable retainer 21 need not be entirely made of deformable material. As such, the base of the fastener/anchor point 27 may be made of a relatively stiff material compared to the rest of the body of the retainer 21. The deformable material used for the body of the retainer 21 may be, for example, an elasticated fabric, cloth or textile, or an elastomeric material. In particular, the deformable material may be a silicone or polysiloxane elastomer. In general, the deformable material is preferably substantially elastically deformable.

Figure 13:
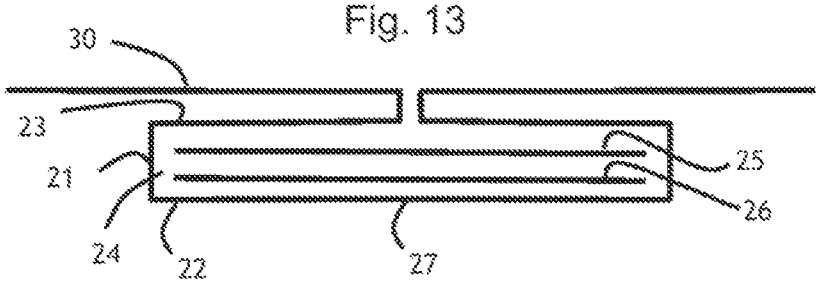
FIG. 13 depicts, in schematic cross-sectional view, a connector according to FIG. 10.

As indicated by the dashed lines in FIG. 11, and shown in the cross-sectional views of FIG. 13 and FIG. 14, the connector can also include one or more plates 25, 26. The one or more plates 25, 26 can be positioned within the inner space 24 of the retainer 21. The one or more plates 25, 26 provide a low friction interface between the first and second sides 22, 23 of the retainer 21. That is, the retainer 21 may deform to allow the first and second sides 22, 23 to move relative to each other, and the low friction interface can facilitate that movement.

As such a connector 20 of the present invention may be configured to permit a desired relative range of movement between the first and second sides 22, 23, and therefore the relative range of movement between the first part of the apparatus the second part of the apparatus being connected. Such configuration may be achieved by the selection of the material forming the retainer 21 and the thickness of the material forming the retainer 21, for example. A connector 20 for use within a helmet may be configured to enable a relative movement of the first and second sides 22, 23 of the retainer 21 of approximately 5 mm or more in any direction within a plane parallel to the sliding interface.

The plates 25, 26 used in the connector 20 may be made from a variety of different materials. In an example, a plate may be made from polycarbonate (PC), polyvinylchloride (PVC), acrylonitrile butadiene styrene (ABS), polypropylene (PP), nylon or another plastic. The plates may optionally have a thickness in the range of from approximately 0.1 mm to approximately 2 mm, optionally 0.2 mm to approximately 1.5 mm, for example approximately 0.7 mm thick.

Providing a first plate 25 within the inner space 24 allows the first side 22 of the retainer 21 and/or the second side of the retainer 21 to slide with respect to the plate, and thus with respect to each other. That is, the plate provides a low friction interface between the (internal) first and second sides 22, 23 of the retainer 21.

Alternatively, first and second plates 25, 26 can be positioned within the inner space 21. This is shown in FIGS. 13 and 14, for example. This provides potential not only for the plates 25, 26 to slide with respect to the inner surfaces of the retainer 21, but also or alternatively with respect to each other. In other words, in this arrangement, there can be a low friction interface between the first and second plates 25, 26 and as such there is a low friction interface between the first and second sides 22, 23 of the retainer 21.

In this context, a low friction interface may be configured such that sliding contact across the interface is still possible even under the loading that may be expected in use. In the context of a helmet, for example, it may be desirable for sliding to be maintained in the event of an impact that is expected to be survivable for the wearer of a helmet. This may be provided, for example, by the provision of an interface between the two surfaces at which the coefficient of friction is between 0.0001 and 0.3 and/or below 0.15.

The low friction interface may be implemented by at least one of: using a low friction material for the construction of the first and/or second sides 22, 23 of the retainer 21; applying a low friction coating to the inner surfaces of the first and second sides 22, 23; using a low friction material for at least one of the plates 25, 26; applying a low friction coating to at least one surfaces of the plates 25, 26; applying a lubricant to any of the structures inside of or forming the inner space 24.

As such, the retainer 21 is not necessarily directly attached or bonded to the plates 25, 26, although in some embodiments such attachment may be present. Instead, the retainer 21 can be provided as a close enough fit around the plates 25, 26 such that it stays in place due to the mechanical interaction with the plates 25, 26. Indeed, to initially fit the plates 25, 26 within the retainer 21, it may be necessary to stretch the retainer 21 and/or bend the plates 25, 26. An example of this is discussed in more detail below.

When viewed in plan view, the anchor points 27, 28 may be arranged substantially at the centre of their respective sides 22, 23 of the retainer 21. However, the present invention is not limited to a particular configuration. When viewed in plan view, any convenient shape of the retainer 21 and plates 25, 26 may be used, for example substantially rectangular, substantially square, substantially circular or substantially elliptical. In the case of a shape having corners, the corners may be rounded in order to minimise the risk of a plate getting caught on another part of the connector or another component.

As can be seen in the Figures, the connector 20 has an aperture 29 in the retainer 21. The aperture 29 is a slit in the depicted embodiments, but any suitable shape could be used.

The aperture 29 allows the insertion of the plates 25, 26 into the inner space of the retainer 21. Because the retainer 21 is deformable, the aperture 29 need not be as large as the plates 25, 26. For example, as shown in FIG. 11, the diameter of the depicted plate 25 is larger than the width of the slit 29. However, the plate 25 can be inserted into the inner space 24 of the retainer 21 through the slit 29, because the slit 29 and the retainer 21 can deform to allow the entry of the plate 25. Providing a slit 29 that is not as large as the diameter of the plate 25 also has the advantage that the plate 25 is held securely within the retainer once the retainer 21 is allowed to return to its original shape As shown in the Figures, the slit can be provided on the second side 23 of the retainer 21, but could also be provided elsewhere.

The second anchor point 28 may be of any of the types discussed in connection with the first anchor point 27, above. However, in the Figures a particular version of the second anchor point 28 is depicted. The second anchor point 28 on the second side 23 of the retainer 21 is depicted in the drawings as comprising a pair of arms 30. The arms 30 extend across the second side 23 of the retainer 21. The arms 30 can also extend beyond the second side 23 of the retainer 21, as shown. That is, the length between the two ends of the arms 30 is longer than the width of the retainer 21.

The arms 30 are integrally formed with the retainer 21, in the embodiments depicted. That is, for example, the arms 30 could be moulded with the retainer 21 as part of a single moulding process.

The arms 30 are preferably deformable. As such, the arms 30 may be made from the same substantially elastically deformable materials as discussed above in connection with the material suitable for use for the retainer 21.

The arms 30 may be attached to the second side 23 of the retainer 21 via a stem 32. Stem 32 also forms part of the second anchor point 28. The stem 32 is optionally made of the same material as the arms 30. The stem 32 can provide a space between the arms and the second side 23 of the retainer 21, to allow the arms to easily fit around a second part 50 as illustrated in FIG. 12, and discussed below.

The arms 30 can be used to manipulate the connector, in particular whilst the connector 20 is being constructed. As such, each arm 30 may comprise a handle 31 provided at end of the arm, to assist with manipulating the connector. For example, when any plates 25, 26 are being inserted into the inner space 24 of the retainer 21, the connector 20 can be held by the arms 30. Because the arms 30 are connected to the second side 23 of the retainer 21, the arms can also be used to stretch the aperture 29, to assist with inserting the plates 25, 26. That is, the arms 30 can be positioned such that they are separated by the aperture 29. Therefore, pulling the arms 30 away from each other will tend to deform the aperture 29 to widen the access through the aperture 29 into the inner space 24.

Also, as part of the anchor point 28, the arms 30 enable the connector 20 to be connected to a layer of material such as the inner shell 14 or liner 15, i.e. the second part 50 that the connector 20 is being connected to. FIG. 12 illustrates how the arms can be used to connect through and around a hole in a second part 50. Because the arms 30 are deformable, they can be fed through a hole in a second part 50, which hole can be smaller than the size of the retainer 21. Once the arms 30 are fed through the hole in the second part 50, the arms can spread out either side of the hole, extending in a direction that would be across the second side of the retainer 21 (although the arms 30 are separated from that second side 23 by the presence of the second part 50). As such, the connector 20 is then connected to the second part 50 by the physical interlocking of the retainer 21 and the arms 30 around the second part 50.

In other words, the retainer 21 and the arms 30 can extend on different sides of the second part 50 beyond the hole through the second part 50, with the stem 32 positioned within the hole in second part 50. The connector 20 is thus connected to the second part 50 via the second anchor point 28. It is then difficult to remove the connector 20 without deliberately intending to do so. To further reinforce the attachment of the connector 20 to the second part 50, or for aesthetic reasons, it may be desirable to place an adhesive patch or sticker on the second part 50 over the arms 30, once they have been inserted through the hole in the second part 50. However, this is not necessary to achieve the connecting function.

As mentioned above, the arms 30 and stem 32 may be formed as a single piece with the retainer 21, by moulding for example. However, the connector may be formed by connecting together multiple pieces, e.g. either side of the inner space 24, subsequently joined at the edges.

The preceding discussion has primarily considered the connector 20 shown in FIGS. 10-14 in isolation or in general use. However, as will be understood from the earlier description, such a connector 20 may be of specific use in helmets, where it is desirable for two parts to be able to move with respect to each other whilst also being connected. For example, the connector 20 could be arranged to have the arms 30 positioned through a hole in a helmet liner, with the other side (i.e. the first side 22 and anchor point 27) arranged to connect to the inside of the helmet (e.g. an inner energy absorbing layer 3). Such a liner may comprise comfort padding and/or a layer of relatively hard material, such as the inner shell 14. In use, when such a connected liner/helmet arrangement is worn by a user, the connector 20 will allow for the liner to slide with respect to the helmet, by virtue of the first and second sides 22, 23 moving with respect to the low friction interface between then.

Advantageously, a liner for a helmet may be provided pre-connected to the connectors 20, leaving the first side 22 and associated first anchor point 27 free for connection to the helmet.

The invention claimed is:

1. A connector for connecting first and second parts of an apparatus, the connector comprising:

a deformable retainer having first and second sides around an inner space; and a first plate positioned within the inner space to provide a low friction interface between the first and second sides of the retainer;

a second plate positioned within the inner space, the first plate and the second plate being configured to slide with respect to each other to provide the low friction interface between the first and second sides of the retainer;

wherein the first side of the retainer has a first anchor point that is configured to connect the connector to the first part of the apparatus; and the second side of the retainer has a second anchor point that is configured to connect the connector to the second part of the apparatus.

2. The connector according to claim 1, wherein the retainer has an aperture through which the first plate is insertable during assembly of the connector.

3. The connector according to claim 2, wherein the aperture is on the second side of the retainer.

4. The connector according to claim 2, wherein the second anchor point comprises a pair of arms extending outwards from opposite edges of the aperture.

5. The connector according to claim 4, wherein the pair of arms are integrally formed with the retainer.

6. The connector according to claim 4, wherein the pair or arms are deformable.

7. The connector according to claim 4, wherein the pair of arms extend across the second side of the retainer.

8. The connector according to claim 4, wherein the pair of arms extend beyond the second side of the retainer.

9. The connector according to claim 4, wherein the connector is configured to connect to the second part of the apparatus by passing the pair of arms through an opening in the second part of the apparatus.

10. The connector according to claim 1, wherein the deformable retainer is at least partially formed from a deformable material.

11. The connector according to claim 1, wherein the deformable retainer comprises a fastener positioned on the first side of the retainer as the first anchor point.

12. The connector according to claim 1, wherein the first anchor point comprises space for applying adhesive.

13. The connector according to claim 1, wherein the first plate is not fixed to the retainer.

14. The connector according to claim 1, wherein the first plate comprises a low friction material configured to provide the low friction interface between the first and second sides of the retainer.

15. The connector according to claim 1, wherein the connector is connected to a liner for a helmet.

16. The connector according to claim 15, wherein the liner comprises comfort padding.

17. The connector according to claim 1, wherein the liner is connected to the helmet by the connector.

18. A method of assembling a connector for connecting first and second parts of an apparatus, the method comprising:

forming a deformable retainer having first and second sides around an inner space, a first anchor point that is configured to connect a first side of the connector to the first part of the apparatus, and a second anchor point that is configured to connect the second side of the connector to the second part of the apparatus; and positioning a first plate and a second plate within the inner space to provide a low friction interface between the first and second sides of the retainer;

wherein the connector comprises:

the deformable retainer having first and second sides around an inner space; and the first plate positioned within the inner space to provide a low friction interface between the first and second sides of the retainer;

the second plate positioned within the inner space, the first plate and the second plate being configured to slide with respect to each other to provide the low friction interface between the first and second sides of the retainer;

wherein the first side of the retainer has the first anchor point that is configured to connect the connector to the first part of the apparatus; and the second side of the retainer has the second anchor point that is configured to connect the connector to the second part of the apparatus.

* * * * *